US007705547B2

(12) United States Patent
Schindel et al.

(10) Patent No.: US 7,705,547 B2
(45) Date of Patent: Apr. 27, 2010

(54) HIGH-SIDE CURRENT SENSE HYSTERETIC LED CONTROLLER

(75) Inventors: Darren T. Schindel, Springfield, OH (US); Leonard De Oto, Springfield, OH (US)

(73) Assignee: Honeywell International Inc., Morristown, NJ (US)

( * ) Notice: Subject to any disclaimer, the term of this patent is extended or adjusted under 35 U.S.C. 154(b) by 215 days.

(21) Appl. No.: 11/551,167

(22) Filed: Oct. 19, 2006

(65) Prior Publication Data

US 2008/0106217 A1 May 8, 2008

(51) Int. Cl.
*G05F 1/00* (2006.01)

(52) U.S. Cl. ..... 315/307; 315/291; 315/185 S; 315/247; 315/312

(58) Field of Classification Search ..... 315/291, 315/307–311, 224, 225, 247, 312–326, 200 A, 315/185 S
See application file for complete search history.

(56) References Cited

U.S. PATENT DOCUMENTS 4,379,973 A * 4/1983 Turner et al. ..... 307/112
4,504,776 A * 3/1985 Haville ..... 323/288
5,459,478 A * 10/1995 Bolger et al. ..... 345/46
6,239,716 B1 * 5/2001 Pross et al. ..... 340/815.4
6,535,580 B1 * 3/2003 Strauss et al. ..... 379/27.01
7,157,866 B2 * 1/2007 Komiya et al. ..... 315/312
7,214,952 B2 * 5/2007 Klipstein et al. ..... 250/504 H
7,317,289 B2 * 1/2008 Hung et al. ..... 315/291
7,511,436 B2 * 3/2009 Xu ..... 315/307
7,550,934 B1 * 6/2009 Deng et al. ..... 315/308
2003/0076051 A1 * 4/2003 Bowman et al. ..... 315/200 A
2003/0214242 A1 * 11/2003 Berg-johansen ..... 315/169.3
2003/0227265 A1 * 12/2003 Biebl ..... 315/291
2005/0068459 A1 * 3/2005 Holmes et al. ..... 348/372
2005/0110469 A1 * 5/2005 Inaba et al. ..... 323/222
2006/0043911 A1 * 3/2006 Shao et al. ..... 315/291
2006/0197469 A1 * 9/2006 Kim ..... 315/291
2006/0197720 A1 9/2006 De Oto et al.
2006/0267514 A1 * 11/2006 Xu ..... 315/291
2006/0284865 A1 12/2006 Tobler et al.
2007/0097043 A1 * 5/2007 Yang ..... 345/82

* cited by examiner

*Primary Examiner*—Tuyet Vo
(74) *Attorney, Agent, or Firm*—Black Lowe & Graham PLLC

(57) ABSTRACT

Systems and methods for hysteretically controlling Light Emitting Diodes (LEDs) when the input voltage is greater than or equal to 18 volts. An example system includes one or more LEDs and a circuit electrically coupled to the one or more LEDs. The circuit hysteretically controls an input voltage supplied to the one or more LEDs based on a sensed electric current that passes through the LEDs. The circuit includes a MOSFET switch for switching on and off the input voltage supplied to the one or more LEDs, a current sensing subcircuit including a first integrated circuit (IC) for sensing the current flowing through the one or more LEDs, a hysteretic comparator circuit including a second IC for generating a hysteretic control signal based on the sensed current, and a switch driver including a third IC for controlling operation of the switch based on the generated hysteretic control signal.

14 Claims, 7 Drawing Sheets

HIGH-SIDE CURRENT SENSE HYSTERETIC LED CONTROLLER

BACKGROUND OF THE INVENTION

Current hysteretic controllers for Light Emitting Diodes (LEDs) are either limited to an input voltage below 18 volts or use complex implementations involving level shifting and charge pumps implemented with discrete electronic components to control a high-side switch. Other high voltage LED controllers require large inductor values or sense the current only when the switch is on. This leads to errors in the average value of the current being controlled. Therefore, a need exists for a hysteretic controller with a simple, less costly, implementation that allows for an input voltage greater than or equal to 18 volts.

SUMMARY OF THE INVENTION

The present invention provides systems and methods for hysteretically controlling Light Emitting Diodes (LEDs) when the input voltage is greater than or equal to 18 volts. An example system includes one or more LEDs and a circuit electrically coupled to the one or more LEDs. The circuit hysteretically controls an input voltage supplied to the one or more LEDs based on a sensed electric current that passes through the LEDs.

In one aspect of the invention, the circuit includes a MOSFET switch for switching on and off the input voltage supplied to the one or more LEDs, a current sensing subcircuit for sensing the current flowing through the one or more LEDs, a hysteretic comparator circuit for generating a hysteretic control signal based on the sensed current, and a switch driver for controlling operation of the switch based on the generated hysteretic control signal.

In an additional aspect of the invention, the current sensing subcircuit includes a first integrated circuit (IC), the hysteretic comparator circuit includes a second IC, and the switch driver includes a third IC, resulting in a simple hysteretic controller implementation that accepts input voltages within the range starting at approximately 5 volts up to input voltages greater than 18 volts, such as up to at least approximately 76 volts.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
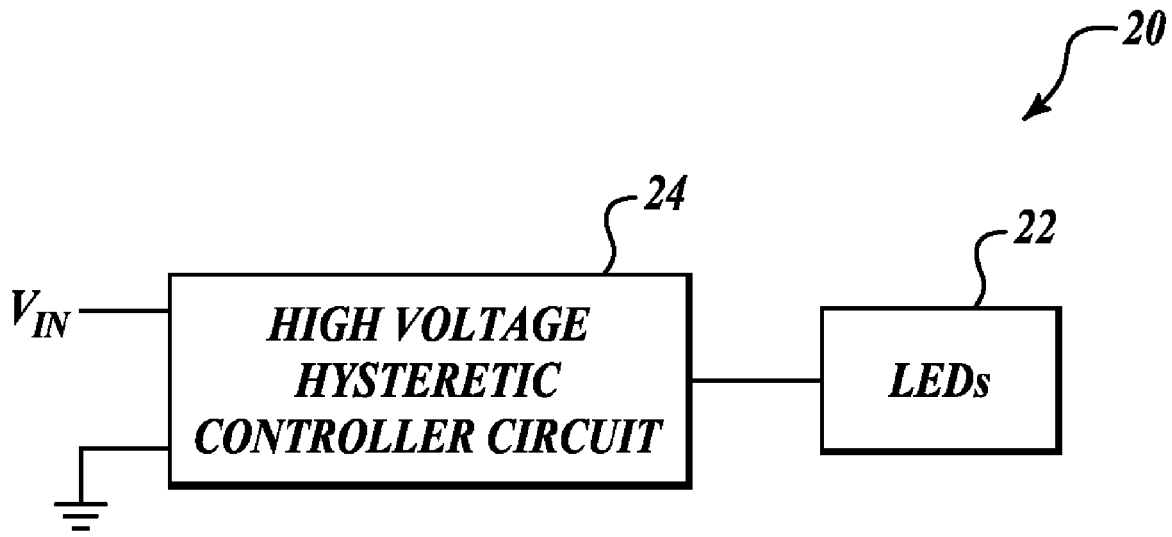
FIG. 1 illustrates an LED controller circuit formed in accordance with an embodiment of the present invention.

FIG. 1 illustrates a Light Emitting Diode (LED) system 20. The system 20 includes one or more LEDs 22 that are controlled by a high voltage hysteretic controller circuit 24. The high voltage hysteretic controller circuit 24 receives an input voltage ($V_{IN}$) that is greater than the voltage provided to the LEDs. Examples of voltage sources for the input voltage include a battery, car alternator, aircraft generator, or a lab power supply. The high voltage hysteretic controller circuit 24 is capable of receiving a $V_{IN}$ greater than or equal to 5 volts up to a $V_{IN}$ of approximately 76 volts with surges to approximately 80 volts and an external ground or return line as inputs and supplying a current that drives the LEDs 22. Generally, the high voltage hysteretic controller circuit 24 provides a relatively constant average current to the LEDs 22 by monitoring the current supplied to the LEDs 22 and hysteretically controlling a switch connected to $V_{IN}$ such that the current remains within a particular range.

Figure 2:
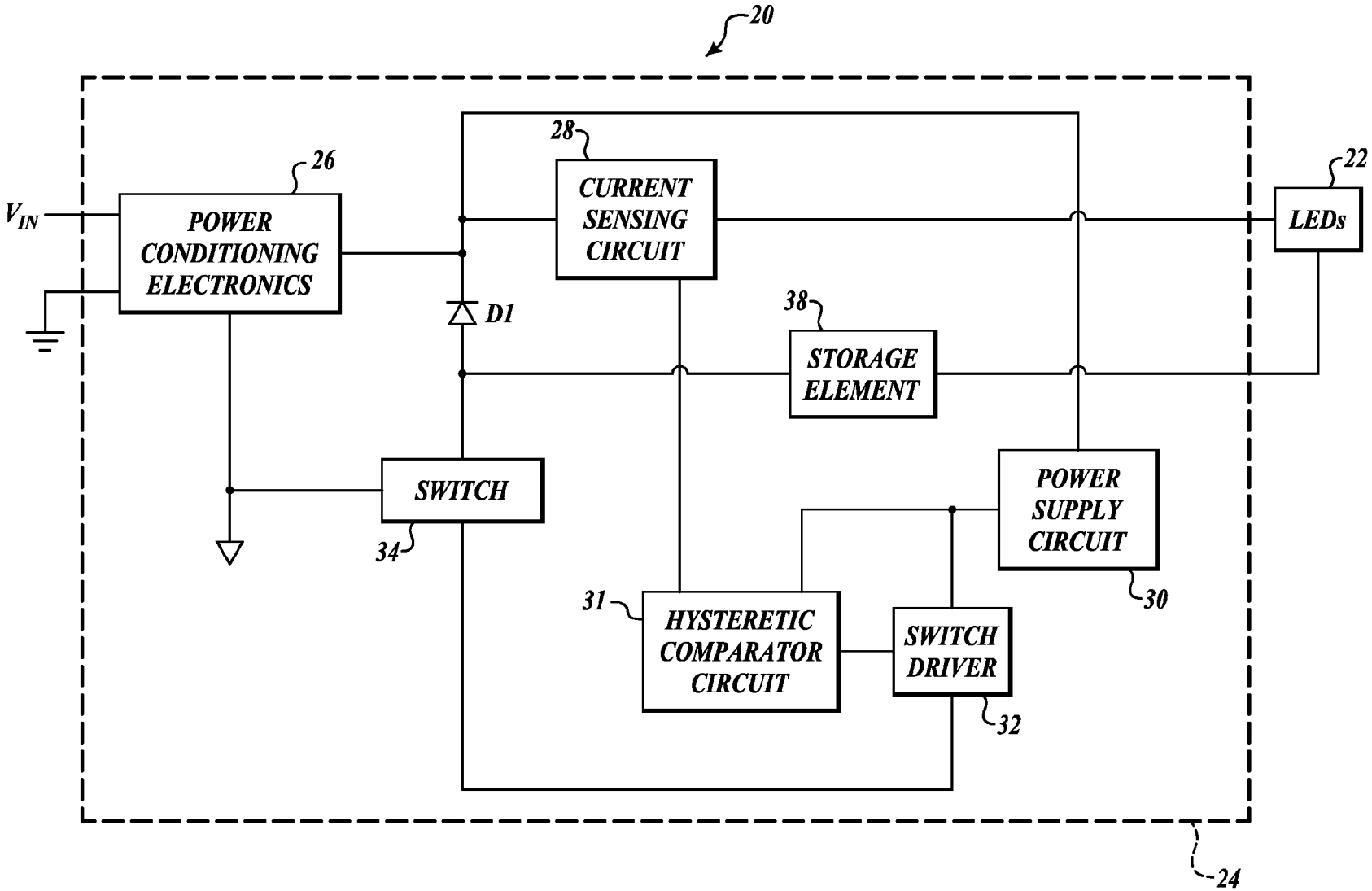
FIG. 2 illustrates additional detail for an example embodiment of the LED controller circuit shown in FIG. 1.

FIG. 2 is a block diagram illustrating additional detail for an example embodiment of the LED system 20 shown in FIG. 1. In this example embodiment, the high voltage hysteretic controller circuit 24 is shown to include a power conditioning circuit 26 that receives $V_{IN}$ as an input and produces a cleaner voltage at an output to be used by other portions of the hysteretic controller circuit 24. The power conditioning circuit 26 reduces radio frequency (RF) noise generated by the hysteretic controller and line voltage spikes in an example embodiment. The output of the power conditioning circuit 26 is connected to a current sensing circuit 28, a power supply circuit 30, and the cathode end of a free-wheeling diode D1. The power supply circuit 30 is used to power a hysteretic comparator circuit 31 and a switch driver 32. The current sensing circuit 28 senses current that passes through the LEDs 22 and produces a voltage output, proportional to the sensed current, which is used as an input by the hysteretic comparator circuit 31. The hysteretic comparator circuit 31 produces an output value that causes the switch driver 32 to turn a switch 34 on and off. When the switch 34 is on, current flows from the power conditioning circuit 26 through the current sensing circuit 28 to power the LEDs 22. The current then passes through a storage element 38 that stores energy to be used when the switch 34 is off. The current then passes through the switch 34 to circuit return. When the current as sensed by the current sensing circuit 28 exceeds a specified threshold as determined by the hysteretic comparator circuit 31, the output value changes causing the switch driver 32 to turn the switch 34 off. When the switch 34 is off, energy stored in the storage element 38 causes a current to flow through the diode D1 and the current sensing circuit 28 before powering the LEDs 22. When the current drops below a specified threshold as sensed by the current sensing circuit 28, the output value produced by the hysteretic comparator circuit 31 changes, thus triggering the switch driver 32 which causes the switch 34 to turn back on.

Figure 3:
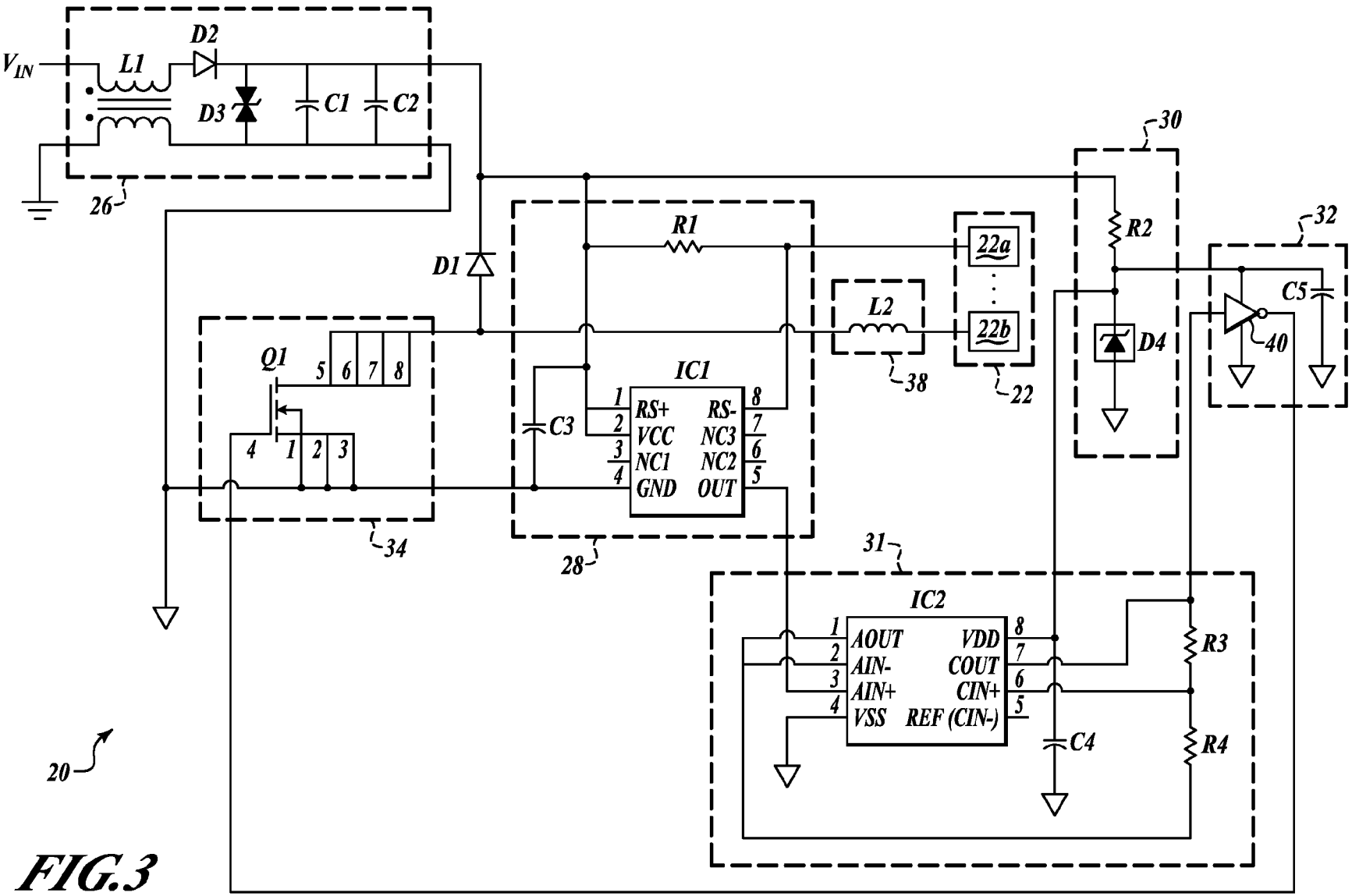
FIG. 3 is a schematic diagram of an example embodiment of the LED controller circuit shown in FIG. 2.

FIG. 3 is a schematic diagram of detailed circuitry for an example embodiment of the LED controller circuit shown in FIG. 2. Only a first LED 22*a* and a last LED 22*b* are shown from the one or more LEDs 22 for clarity. The power conditioning circuit 26 takes $V_{IN}$ and an external ground or return line as inputs. This allows the power conditioning circuit 26 to be connected to a power bus in some embodiments, for example. The $V_{IN}$ and external ground inputs are connected to a common mode choke L1 to reduce electromagnetic interference (EMI). The high side of the choke L1 output is connected to a diode's D2 anode. The low side output of the choke L1 is connected to circuit return. A bidirectional breakdown diode D3, a first capacitor C1, and a second capacitor C2 are connected in parallel between the cathode of the diode D2 and the low side output of the choke L1. The diode D3, first capacitor C1, and second capacitor C2 assist in stabilizing $V_{IN}$ to provide a good voltage source to be used by other components of the high voltage hysteretic controller circuit 24.

The current sensing circuit 28 includes a current sense resistor R1 and a first integrated circuit IC1 that is used to sense the current flowing through the current sense resistor R1. In this example embodiment, the first integrated circuit IC1 is a MAX4080 High Side, Current-Sense Amplifier with Voltage Output, produced by Maxim Integrated Products. However, ICs with similar characteristics could be used in other embodiments. Although the MAX4080 IC is rated to 76 Volts with a surge rating of 80 Volts, higher input voltages may be possible in other embodiments if the IC used is rated to accept them. The RS+, RS−, VCC, GND, and OUT pins of the MAX4080 chip are used. The RS+ and RS− pins are connected to the end of the sense resistor R1 connected to the power conditioning circuit output and the first LED 22*a* anode, respectively. The VCC pin is connected to the power conditioning circuit output, the GND pin is connected to circuit return, and the OUT pin is connected to the hysteretic comparator circuit 31. A third capacitor C3 is electrically connected at one end to both the RS+ and VCC pins and at the other end to the GND pin.

The power supply circuit 30 includes a resistor R2 connected at one end to the output of the power conditioning circuit 26 and at the other end to the cathode end of a unidirectional Zener breakdown diode D4, the anode of the diode D4 being connected to circuit return. The hysteretic comparator circuit 31 includes an integrated circuit IC2 that is powered by the voltage established by the breakdown diode D4. In this example embodiment, the integrated circuit IC2 is a MAX9003 Low-Power, High-Speed, Single-Supply Op Amp+Comparator+Reference IC, produced by Maxim Integrated Products. However, ICs with similar characteristics could be used in other embodiments. The AOUT, AIN−, AIN+, VSS, VDD, COUT, and CIN+ pins of the MAX9003 chip are used. The VDD pin is connected to the cathode end of the breakdown diode D4, the VSS pin is connected to circuit return, and a fourth capacitor C4 is connected between the VDD pin and circuit return. The AIN+ pin is connected to the OUT pin from the MAX4080 chip used as IC1. A third resistor R3 is connected between the COUT and CIN+ pins. A fourth resistor R4 is connected between the CIN+ pin and both the AOUT and AIN− pins. The COUT pin is also connected to the switch driver 32. The third resistor R3 and the fourth resistor R4 are selected to achieve desired on and off points for hysteretic control.

The switch driver 32 is shown to include a MOSFET driver 40 and a fifth capacitor C5. The MOSFET driver 40 includes a power input that is connected to the cathode of the breakdown diode D4, a ground input that is connected to circuit return, a control input that is connected to the COUT pin from the MAX9003 chip used as IC2, and a gate output that is connected to the switch 34. The fifth capacitor C5 is connected between the power input of the MOSFET driver 40 and circuit return. As an example, the MOSFET driver 40 may be a MIC4417 IttyBittty™ Low-Side MOSFET Driver, produced by Micrel, Inc. The MIC4417 driver is an inverting driver that uses a TTL-compatible logic signal as an input. However, other drivers may be used in other embodiments. The MOSFET driver 40 is used to drive the switch 34, which is shown in this embodiment as an N-channel MOSFET transistor Q1 whose gate is driven by the gate output of the MOSFET driver 40, source is connected to circuit return, and drain is connected to one end of the storage element 38. In this embodiment, the storage element 38 is an inductor L2 whose other end is connected to the cathode of the last LED 22*b* in the one or more LEDs 22.

When $V_{IN}$ is applied, the high voltage hysteretic controller circuit 24 powers up in a state such that the output of the hysteretic comparator circuit 31 is low. This places the MOSFET transistor Q1 in its 'ON' state using the switch driver 32. The current in the inductor L2 begins to ramp up and the LEDs 22 illuminate as the current is passing through them. The high-side current sensing circuit 28 amplifies the voltage developed across the sense resistor R1 to provide an amplified sense signal output voltage that is proportional to the voltage developed across the sense resistor R1. The amplified sense signal output voltage is fed to the hysteretic comparator circuit 31. When the amplified sense signal output voltage equals the threshold value of the hysteretic comparator circuit 31, the output of the hysteretic comparator circuit 31 transitions from low to high, establishing a new threshold value. The high on the output of the hysteretic comparator circuit 31 turns the MOSFET transistor Q1 'OFF' using the switch driver 32. This causes the current in the inductor L2 and the LEDs 22 to recirculate through the free-wheeling diode D1. As the current ramps down, the high side current sensing circuit 28 continues to provide a signal that is proportional to the current in the LEDs 22. When the amplified signal equals the lower threshold value of the hysteretic comparator circuit 31, the output of the hysteretic comparator circuit 31 transitions from high to low, turning the MOSFET transistor Q1 back 'ON' using the switch driver 32 and reestablishing the high threshold value. The cycle then repeats.

Figure 4:
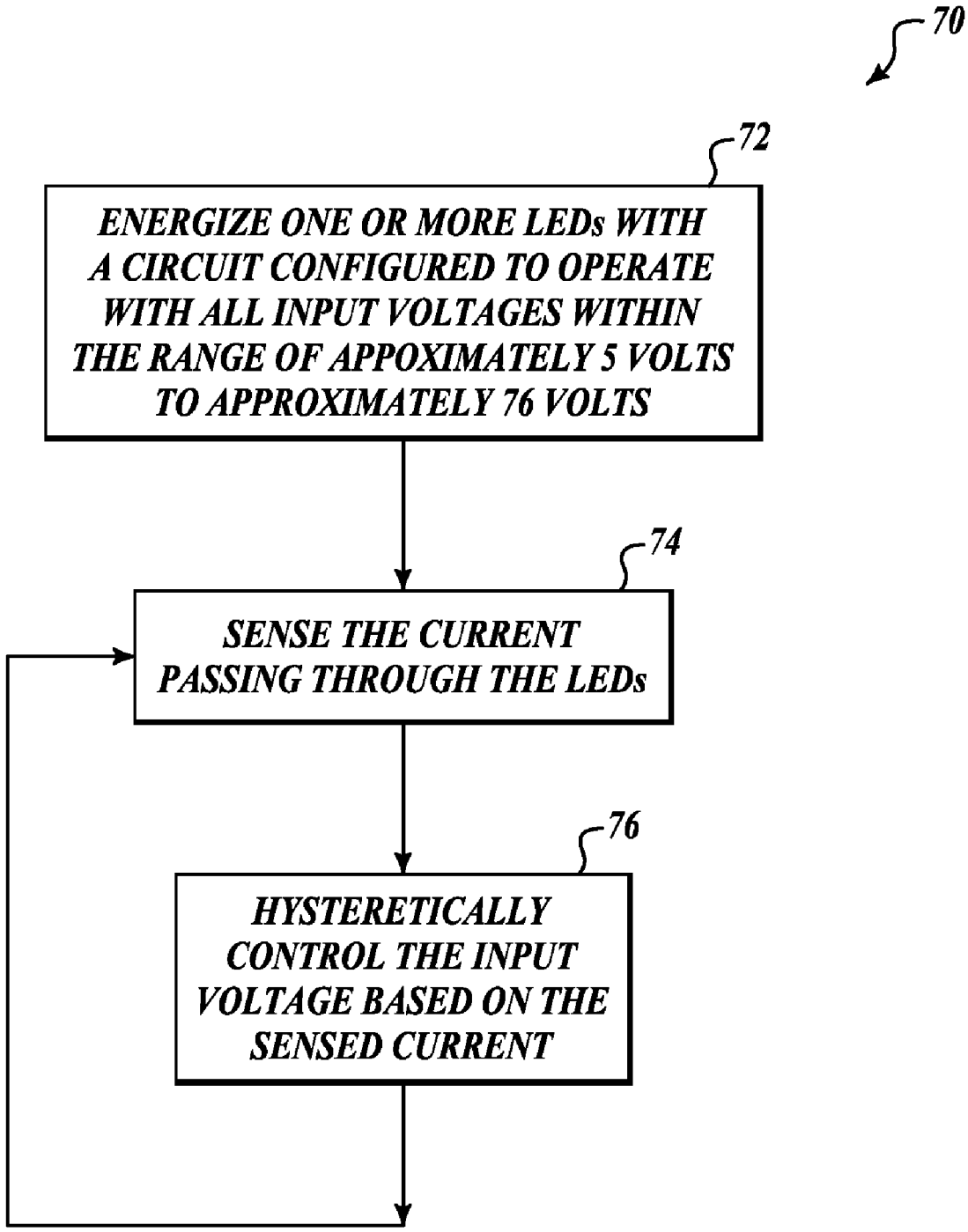
FIGS. 4 and 5 are flowcharts of a method of controlling one or more LEDs in accordance with an embodiment of the invention.
Figure 5:
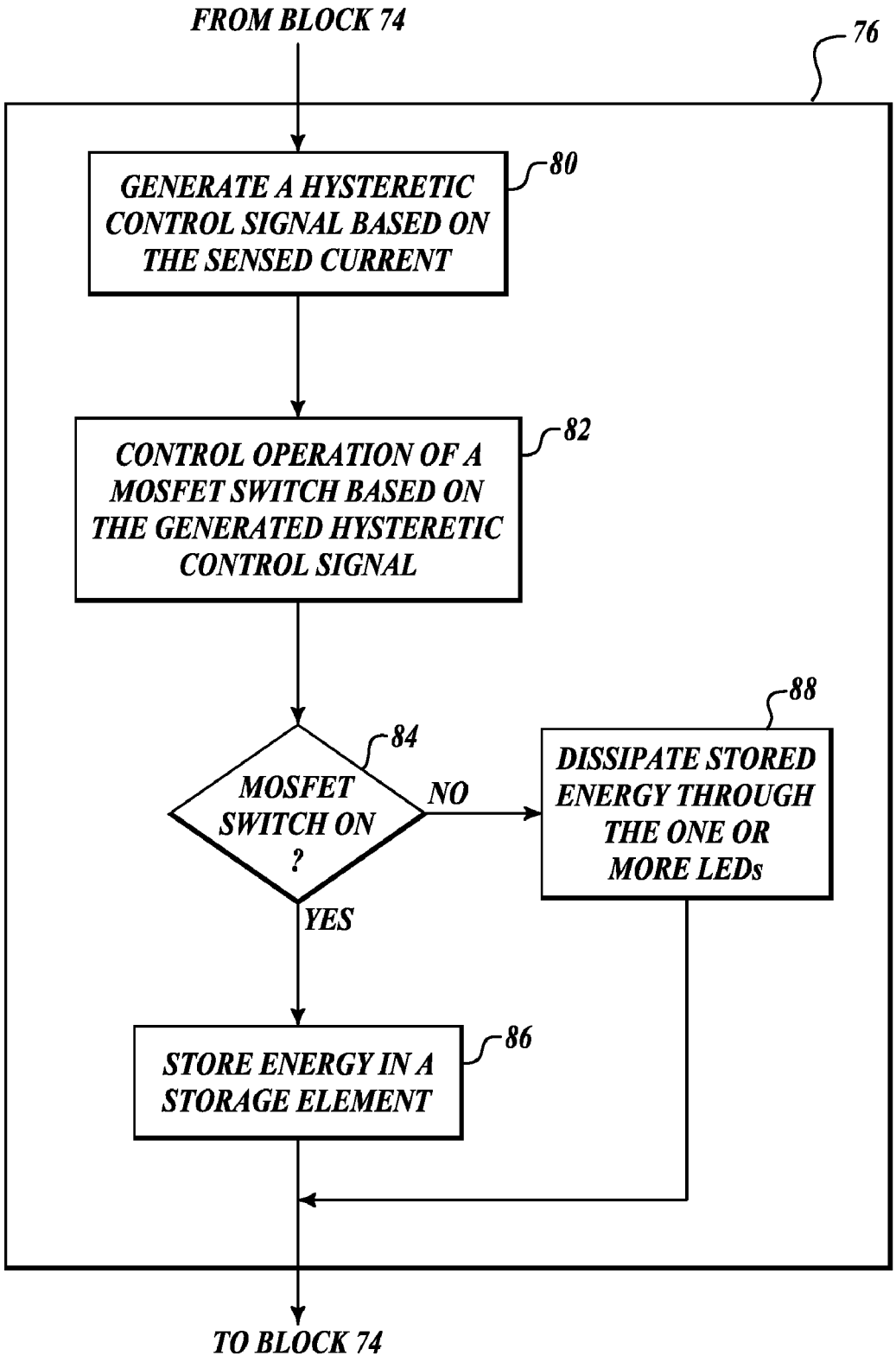

FIGS. 4 and 5 are flowcharts of a method 70 of controlling one or more LEDs in accordance with an embodiment of the invention. FIG. 4 shows that the method 70 begins at a block 72 where one or more LEDs are energized with a circuit configured to operate with all input voltages within the range of approximately 5 volts to approximately 76 volts. Next, at a block 74, the current passing through the LEDs is sensed. Then, at a block 76, the input voltage is hysteretically controlled based on the sensed current. The method 70 then loops back to the block 74 where the current passing through the LEDs is sensed again. In an example embodiment illustrated in FIG. 5, the block 76 is shown to include a number of other blocks that describe in greater detail an example method of hysteretically controlling the input voltage based on the sensed current. First, at a block 80, a hysteretic control signal is generated based on the sensed current. Next, at a block 82, a MOSFET switch is controlled based on the generated hysteretic control signal. Then, at a decision block 84, it is determined whether the MOSFET switch is on. If the MOSFET switch is on, energy is stored in a storage element at a block 86 and the LEDs are powered by the input voltage. Then, the method loops back to the block 74. If the MOSFET switch is off, the stored energy in the storage element is dissipated through the one or more LEDs at a block 88. Then, the method loops back to the block 74.

Figure 6:
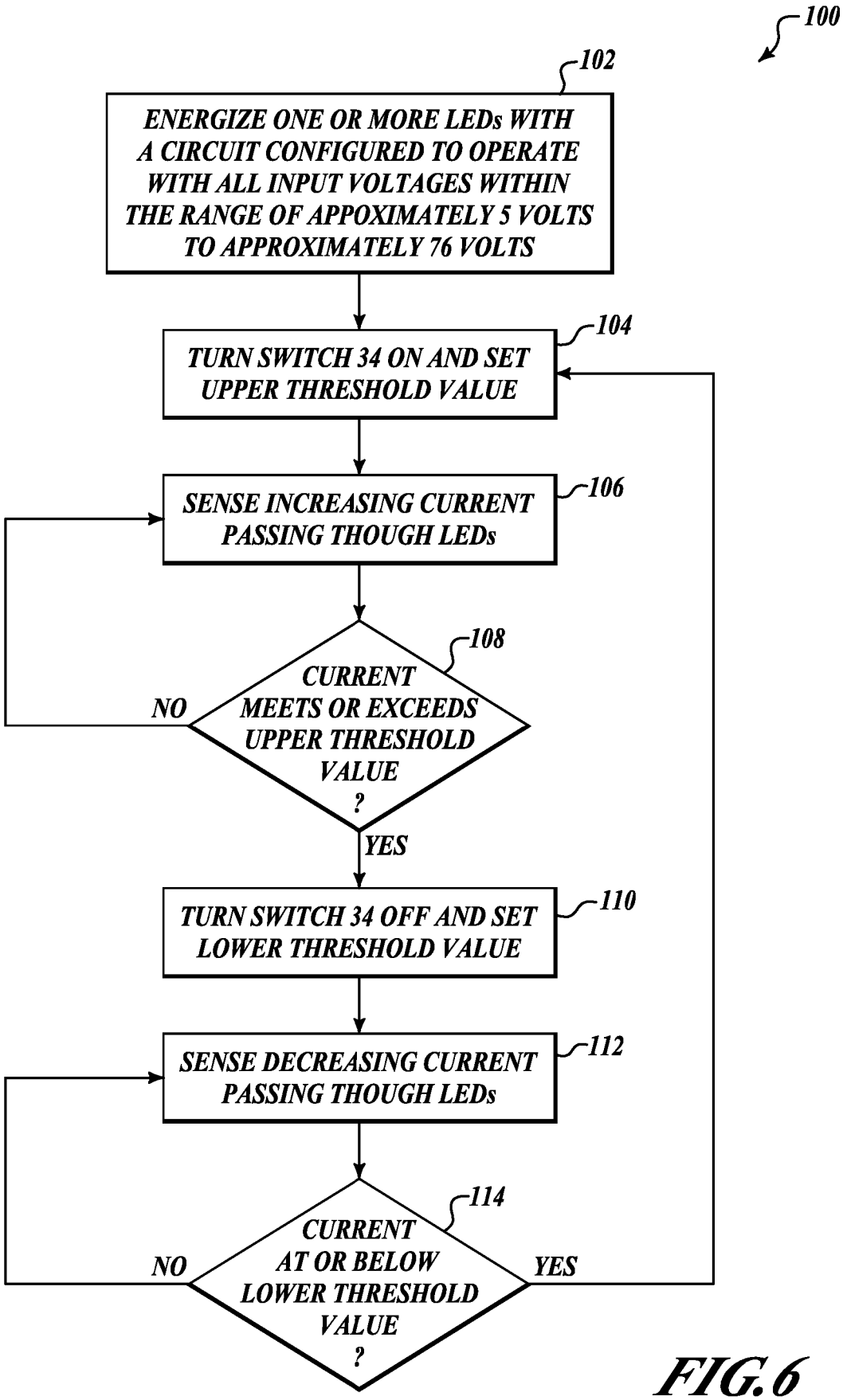
FIG. 6 is a flowchart of a method describing the functionality of the circuit shown in FIGS. 2 and 3.

FIG. 6 is a flowchart of a method 100 describing the functionality of the circuit 20 shown in FIGS. 2 and 3. First, at a block 102, one or more LEDs are energized with a circuit configured to operate with all input voltages within the range of approximately 5 volts to approximately 76 volts. Next, at a block 104, the switch 34 is turned on and an upper threshold value for the hysteretic comparator circuit 31 is set. Then, at a block 106, increasing current passing through the LEDs 22 is sensed with the current sensing circuit 28. Then, at a decision block 108, it is determined whether the sensed current meets or exceeds the upper threshold value. If the sensed current does not meet or exceed the upper threshold value, the method 100 loops back to the block 106. If the sensed current does meet or exceed the upper threshold value, the method proceeds to a block 110 where the switch 34 is turned off and the lower threshold value is set. Then, at a block 112, decreasing current is sensed passing through the LEDs 22 with the current sensing circuit 28. Next, at a decision block 114, it is determined whether the sensed current is at or below the lower threshold value. If the sensed current is not at or below the threshold value, the method loops back to the block 112. If the sensed current is at or below the threshold value, the method loops back to the block 104 where the switch 34 is turned on again and the upper threshold value is set. The method 100 then proceeds as described above.

Figure 7:
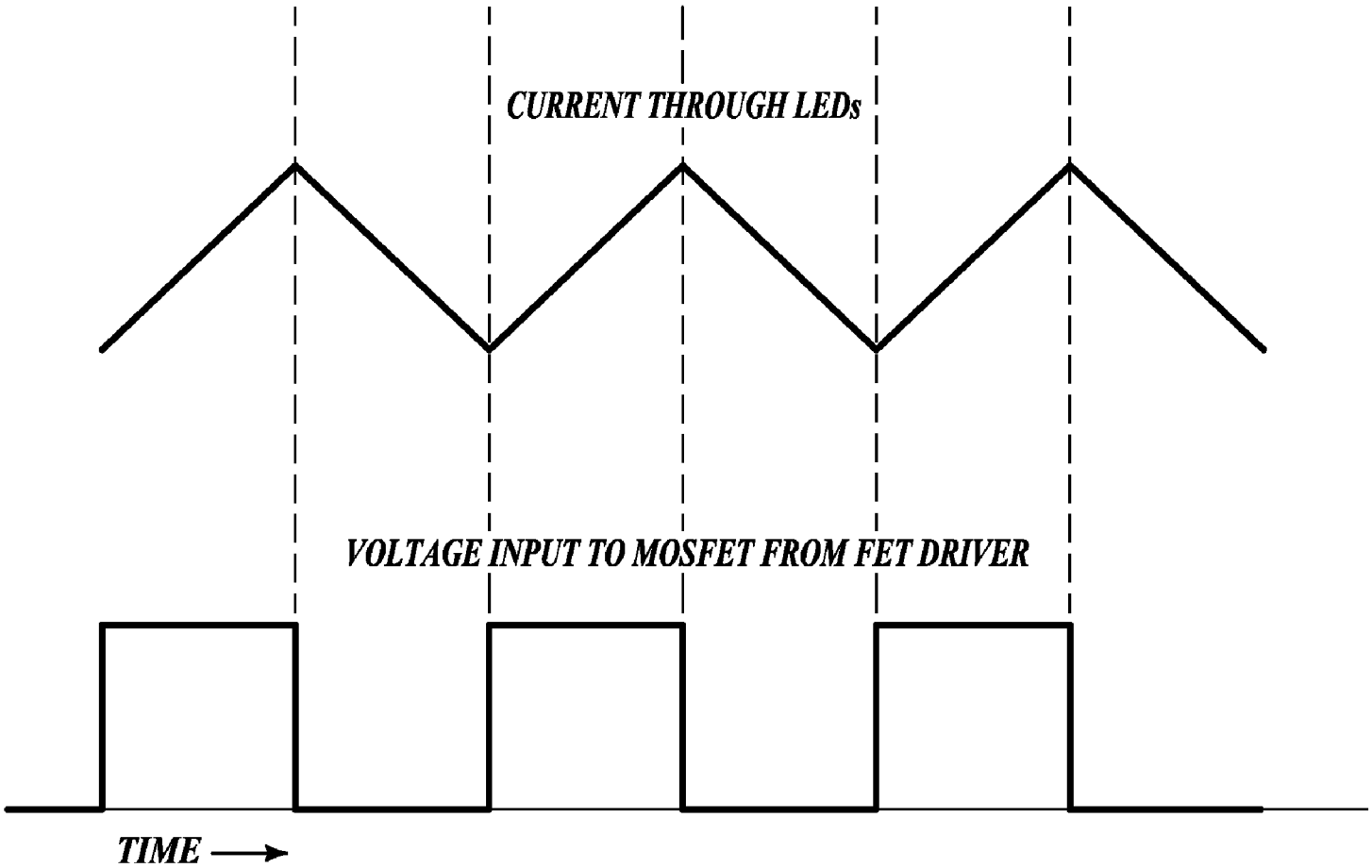
FIG. 7 is an example timing diagram for the circuit shown in FIGS. 2-3 and processes shown in FIGS. 4-6.

FIG. 7 is an example timing diagram for the circuit shown in FIGS. 2-3 and processes shown in FIGS. 4-6.

While the preferred embodiment of the invention has been illustrated and described, as noted above, many changes can be made without departing from the spirit and scope of the invention. For example, changes could be made to the power conditioning circuit such as combining the first capacitor C1 and the second capacitor C2, or the power conditioning circuit could be eliminated if a clean and stable voltage source was available as an input. Additionally, different types of ICs that perform similar functions to the example ICs mentioned could be used. Further, a non-inverting switch driver rather than an inverting switch driver 32 could be used if the hysteretic comparator circuit 31 output was also changed. Additionally, a $V_{IN}$ lower than 18 V could be used depending on how many LEDs were being driven. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A Light Emitting Diode (LED) system comprising:
one or more LEDs; and
a circuit electrically coupled to the one or more LEDs for hysteretically controlling an input voltage supplied to the one or more LEDs,
wherein the circuit is configured to operate with all input voltages within a range of approximately 5 volts to approximately 76 volts,
wherein the circuit comprises:
a switch for switching on and off the input voltage supplied to the one or more LEDs;
a current sensing subcircuit for sensing the current flowing through the one or more LEDs;
a hysteretic comparator subcircuit for generating a hysteretic control signal based on the sensed current; and
a switch driver for controlling operation of the switch based on the generated hysteretic control signal, and
wherein the current sensing subcircuit senses current on a high side of the one or more LEDs.

2. The system of claim 1, wherein the circuit is configured to operate with input surge voltages up to approximately 80 volts.

3. The system of claim 1, wherein the switch includes a MOSFET switch.

4. The LED system of claim 1, wherein the circuit is electrically coupled to a plurality of LEDs for hysteretically controlling an input voltage supplied to the plurality of LEDs.

5. The system of claim 1, wherein the circuit further comprises a storage element configured to store energy when the switch is turned on and the stored energy is dissipated to the one or more LEDs when the switch is turned off.

6. The system of claim 5, wherein the storage element includes an inductor connected in series with the one or more LEDs.

7. A method for controlling a current through one or more Light Emitting Diodes (LEDs), the method comprising:
sensing current passing though the LEDs; and
hysteretically controlling an input voltage used to power the one or more LEDs based on the sensed current,
wherein the input voltage is within a range of approximately 5 volts to approximately 76 volts, and wherein sensing current occurs on a high side of the LEDs.

8. The method of claim 7, wherein the input voltage is between approximately 18 volts and approximately 76 volts.

9. The method of claim 7, wherein the input voltage contains voltage surges of up to approximately 80 volts.

10. The method of claim 7, wherein sensing current includes sensing current passing through a plurality of LEDs.

11. The method of claim 7, wherein hysteretically controlling comprises:
generating a hysteretic control signal based on the sensed current; and
controlling operation of a MOSFET switch based on the generated hysteretic control signal.

12. The method of claim 11, further comprising:
storing energy in a storage element when the MOSFET switch is turned on; and
dissipating the stored energy through the one or more LEDs when the MOSFET switch is turned off.

13. The method of claim 12, wherein controlling comprises:
receiving the generated hysteretic control signal at a switch driver; and
driving the MOSFET switch based on the received hysteretic control signal.

14. A Light Emitting Diode (LED) system comprising:
one or more LEDs; and
a circuit electrically coupled to the one or more LEDs for hysteretically controlling an input voltage supplied to the one or more LEDs,
wherein the circuit is configured to operate with all input voltages within a range of approximately 5 volts to approximately 76 volts, wherein the circuit comprises:
a switch for switching on and off the input voltage supplied to the one or more LEDs;
a current sensing subcircuit for sensing the current flowing through the one or more LEDs;
a hysteretic comparator subcircuit for generating a hysteretic control signal based on the sensed current; and
a switch driver for controlling operation of the switch based on the generated hysteretic control signal,
wherein the current sensing subcircuit comprises:
a resistor connected in series with the one or more LEDs; and
a current sensing integrated circuit connected across the resistor, wherein an output of the current sensing integrated circuit is connected to an input of the hysteretic comparator subcircuit.

* * * * *